US005374063A

United States Patent [19]

Ogden

[11] Patent Number: 5,374,063

[45] Date of Patent: Dec. 20, 1994

[54] GOLF APPARATUS

[75] Inventor: Everett L. Ogden, Crown Point, Ind.

[73] Assignee: The Zelar Corp., Ponte Vedra Beach, Fla.

[21] Appl. No.: 50,816

[22] Filed: Apr. 21, 1993

Related U.S. Application Data

[63] Continuation-in-part of Ser. No. 32,689, Mar. 17, 1993, abandoned.

[51] Int. Cl.[5] ..... A63B 69/36

[52] U.S. Cl. ..... 273/186.3; 273/186.2

[58] Field of Search ..... 273/183.1, 186.2, 186.3

[56] References Cited

U.S. PATENT DOCUMENTS

| | | | |
|---|---|---|---|
| 3,194,563 | 7/1965 | Mackniesh | 273/186.2 |
| 3,802,709 | 4/1974 | Elkins | 273/186.2 |
| 4,146,239 | 3/1979 | Foster | 273/186 |
| 4,251,077 | 2/1981 | Pelz et al. | 273/183.1 |
| 4,254,956 | 3/1981 | Rusnak | 273/186 |
| 4,306,722 | 12/1981 | Rusnak | 273/186 |
| 4,342,455 | 8/1982 | Miyamae | 273/186.2 |
| 4,342,456 | 8/1982 | Miyamae | 273/186 |
| 4,601,472 | 7/1986 | O'Flanagan | 273/186.2 |
| 4,819,942 | 4/1989 | Lee et al. | 273/186 |
| 4,898,389 | 2/1990 | Plutt | 273/186 |
| 4,911,450 | 3/1990 | Rabold | 273/186 |
| 4,930,787 | 6/1990 | Nobles, Jr. | 273/186.3 |
| 4,971,328 | 11/1990 | Hernberg | 273/186 |
| 4,979,745 | 12/1990 | Kobayashi | 273/186 |
| 4,997,189 | 3/1991 | Perkins | 273/186.2 |
| 5,000,456 | 3/1991 | Rabold | 273/186 |
| 5,029,868 | 7/1991 | Cloud | 273/186.3 |
| 5,082,282 | 1/1992 | Hernberg | 273/186 |
| 5,135,229 | 8/1992 | Archer | 273/186.2 |

*Primary Examiner*—Jessica J. Harrison
*Attorney, Agent, or Firm*—Thomas C. Saitta

[57] ABSTRACT

A golf apparatus is provided for practicing aligning the head of a golf club with a golf ball to be struck by the club head prior to swinging the club. The golf apparatus has a light source on the club head for directing a beam of light toward a golf ball and a receiver on the club head for receiving light reflected by the golf ball. The light source and the receiver are positioned such that reflected light reaches the receiver when the golf club head and the golf ball are in a predefined relative position. In the predefined relative position of the club head and a golf ball, a line connecting the center of a golf ball and a point of preferred contact on the club face is perpendicular to the club face. An indicator light on the club head provides a visible indication that the club head and a golf ball are in the predefined relative position.

17 Claims, 2 Drawing Sheets

GOLF APPARATUS

This application is a continuation in pan of U.S. Ser. No. 08/032,689 filed Mar. 17, 1993, now abandoned.

BACKGROUND OF THE INVENTION

1. Technical Field

This invention relates to an apparatus for approaching and practicing golf and, more particularly, to an apparatus for practicing aligning the head of a golf club with a golf ball to be struck by the club head.

2. Background Art

Many factors contribute to the consistency and overall success with which an individual plays the game of golf. For instance, a golfer's stance. the trajectory of the head of a golf club during a swing and the position of a golfer's hands on a golf club are but a few of the many variables which affect the path a golf ball follows after being struck.

In addition to the foregoing factors, it generally is recognized that a determinative consideration in the results achieved by a golfer is the position at which a golfer maintains the head of a golf club relative to a golf ball prior to and during impact.

More specifically, it is desired that a golfer strike a golf ball with the impact center or "sweet spot" of a club face. The impact center is established by the distribution of mass in the club head. As is generally known by those skilled in the art, when an article is struck with the impact center of a rigid object, reaction force applied to the object acts through the object's center of inertia and, consequently, does not tend to rotate the object. In the case of a golf club, by avoiding rotation of the club head, the club does not impart side spin to a golf ball which otherwise could cause the ball to drift from a desired path to a target.

Moreover, it is known that a golf ball is more likely to travel along an intended path when the club face is square to the ball at the moment of impact, which is to say that the club head at impact preferably moves along a path which is perpendicular to the face of the club. The orientation of the club face is particularly important with regard to putting.

A variety of devices have been proposed for improving the ability of a golfer to strike a golf ball with the impact center of a club face and for improving the ability of a golfer to a hold the face of a club head square to a golf ball. Prior devices have considerable shortcomings, however, and generally have failed to provide the anticipated results.

For example, U.S. Pat. No. 4,898,389, issued Feb. 6, 1990, discloses a golf club having a plurality of impact sensitive transducers. After repetitively striking golf balls with the club, a golfer obtains a readout from a monitor associated with the transducers to ascertain whether the balls are being hit at the sweet spot of the club head. Not only does this approach require a significant investment in pressure transducers and signal processing equipment, but a golfer cannot practice his technique without actually striking a golf ball. Thus, a golfer is faced with the inconvenience of repeatedly retrieving golf balls and, in addition, the technique only can be practiced in an area sufficiently large to accommodate the travel of a golf ball. Further, the disclosed device fails to provide a solution to or even address the problem of hitting a golf ball squarely.

U.S. Pat. No. 4,306,722, issued Dec. 22, 1981, shows a device wherein the attitude of a club face at impact is measured with an optical sensing apparatus. Light is projected from a remote source onto a reflective impact surface of a golf club when the club is swung. Reflected light is focused through a series of fixed lens and provides an indication of the orientation of the club face at impact. This latter device requires the provision and accurate alignment of lenses and a light source remote from a golf club. The disclosed technique therefore can be practiced only at the site of the lens/light fixture. In addition, the '722 device is incapable of providing feedback as to the relationship between a golf ball and the sweet spot of a golf club.

SUMMARY OF THE INVENTION

It is an object of the present invention, therefore, to provide an improved golf apparatus for aligning the head of a golf club with a golf ball to be struck by the club head.

In the exemplary embodiment of the invention, a golf apparatus is used with a golf club having an elongated shaft with a club head at one end thereof. The club head has a substantially planar club face for striking a golf ball when the club is swung. Generally, a microbeam sensor on the club head is operable to detect a predefined relationship between the position of the club head and the position of a golf ball to be struck by the club head. An indicator light provides a visible indication that the club head and the golf ball are in the predefined relative position prior to swinging the club.

Particularly, the microbeam sensor has a light source for directing a beam of light toward a golf ball and a receiver for receiving light reflected by the golf ball. The light source and the receiver are positioned such that reflected light reaches the receiver when the golf club head and the golf ball are in the predefined relative position. More specifically, in the predefined relative position, a line connecting the center of the golf ball and a point of preferred contact on the club face is perpendicular to the club face. The light source and the receiver are spaced equidistantly from the point of preferred contact on the club face. In addition, the light is positioned to direct a beam of light onto a golf ball which is spaced from the point of preferred contact on the club face a distance in the range of about two inches to about four inches.

The invention contemplates that the light source and the receiver are embedded in the club head. The club head has a first opening in the club face through which a light beam is directed by the light source and a second opening in the club face through which light is reflected by a golf ball. A transparent window covers the openings in the club face.

The golf club preferably has a self-contained energy source. A switch is interconnected between the energy source and the microbeam sensor for selectively interrupting a supply of energy to the light source. The switch preferably is a mercury switch having an attitude sensitive component for automatically interrupting a supply of energy when the club is not upright. A timer shuts off the switch after a predefined period of activation.

An alternative embodiment of a golf apparatus according to the invention has two microbeam sensors embedded in the head of a golf club. Each sensor includes a light source for directing a beam of light toward a golf ball and a receiver for receiving light reflected by the golf ball. Each microbeam sensor is aligned with a separate opening in the club face and the sensors are spaced apart equidistantly from the point of preferred contact on the club face. A first indicator lamp on the club head is illuminated when light from the source in one sensor is reflected on the receiver in the one sensor. A second indicator lamp on the club head is illuminated when light from the source in the other sensor is reflected on the receiver in the other sensor. The microbeam sensors are positioned such that the two indicator lamps are both illuminated only when the golf club head and the golf ball are in a predefined relative position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

DETAILED DESCRIPTION OF THE INVENTION

Figure 1:
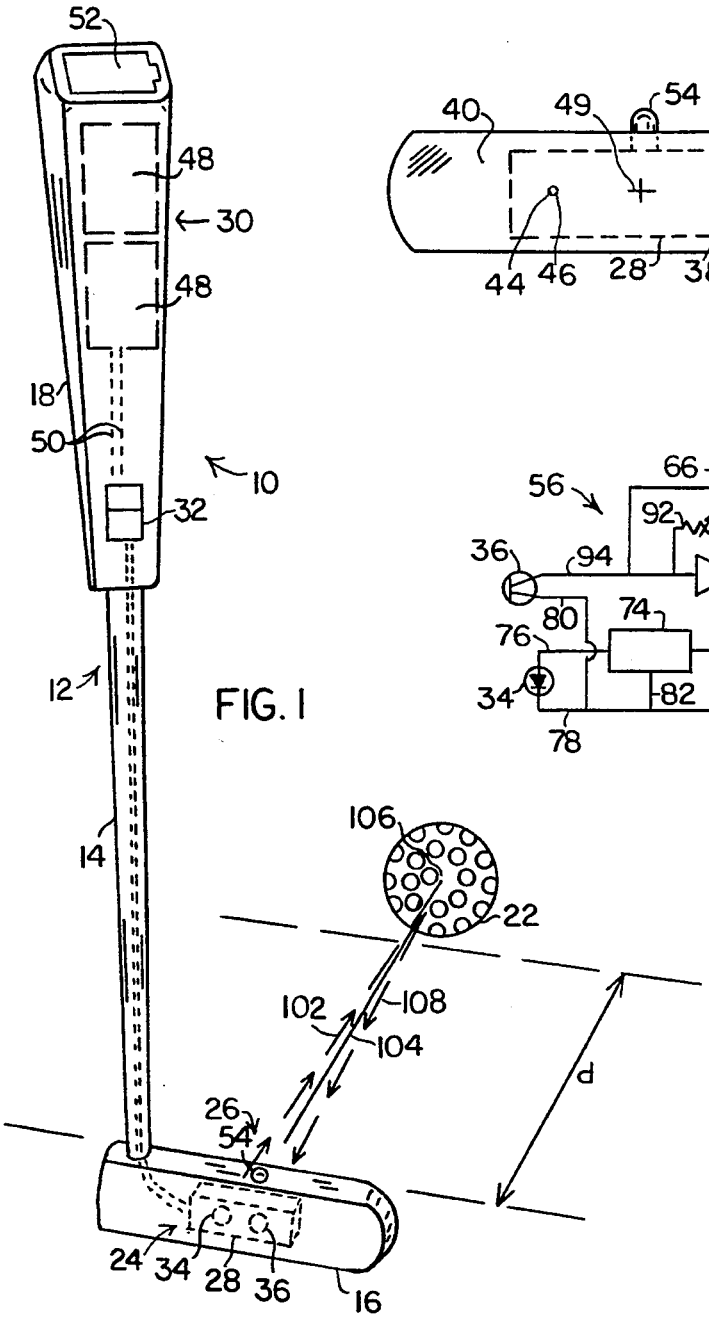
FIG. 1 is a somewhat schematic illustration of a golf apparatus according to the invention.

A golf apparatus according to the invention is generally designated 10 in FIG. 1 and includes a golf club 12 having an elongated shaft 14 and a club head 16 connected to a bottom end of the club shaft. A golfer grasps a grip 18 at the top end of shaft 14 to swing the golf club and strike a golf ball 22 with club head 16. Sensing means, generally designated 24, are provided for detecting a predefined relationship between the position of club head 16 and the position of golf ball 22 prior to swinging golf club 12. Indicator means 26 provide an indication that club head 16 is in the predefined relationship with golf ball 22. Consequently, and as will be understood from the following discussion, golf apparatus 10 advantageously can be used to practice positioning club head 16 relative to a golf ball to be struck by the club head without swinging golf club 12. Alternatively, as the golfer practices the proper position alignment of the club head, the golfer can proceed to swing the club, strike the ball and learn to maintain the proper position alignment of the club head as indicated by the apparatus of the invention.

Figure 2:
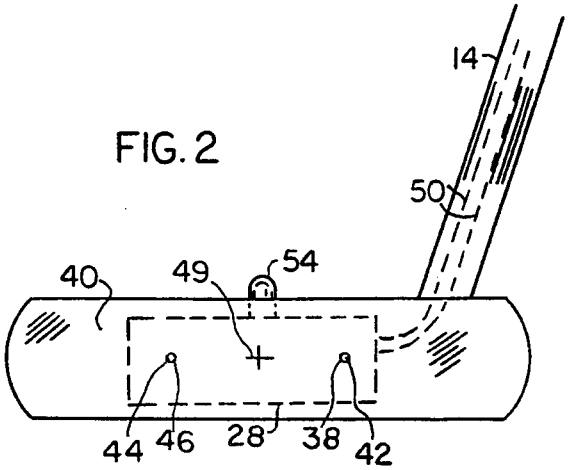
FIG. 2 is a side elevation of a golf club head in the apparatus.

More particularly, referring to FIG. 2 in conjunction with FIG. 1, sensing means 24 includes a diffused reflective microbeam sensor 28, an energy source 30, and switch means 32 interposed between the microbeam sensor and the energy source for selectively providing electrical energy from the energy source to the microbeam sensor as well as to indicator means 26.

Microbeam sensor 28 is embedded in club head 16 and has a light emitting diode (such as an LED or a laser diode) 34 (see FIG. 1) and a light receiving photo transistor 36. Laser diode 34 is aligned with a first opening 38 (see FIG. 2) on the impact face 40 of club head 16 (see FIG. 2) so that a beam of light emitted by laser diode 34 projects from impact face 40 through opening 38. A transparent film or window 42 preferably covers opening 38. Photo transistor 36 is aligned with a second opening 44 on impact face 40 so that light directed into opening 44 strikes the photo transistor. A transparent film or window 46 preferably covers opening 44.

For purposes made clear below, openings 38 and 44 are equidistantly spaced from opposite sides of a point 49 of preferred contact on club face 40. Point 49 preferably coincides with the impact center or "sweet spot" of club face 40, which is to say that the point 49 represents a location on club head 16 which, when contacted by a golf ball, produces no rotational tendency of golf club 12 in the hands of a golfer.

Energy source 30 is positioned within grip 18 and is selected to provide sufficient and compatible electrical power for operating microbeam sensor 28 and indicator means 26, as described hereinafter. In the exemplary embodiment, energy source 30 is provided by a pair of serially conducting nine-volt batteries 48 connected to switching means 32 by a conductive wire 50. Grip 18 has a removable door 52 for installing and removing batteries 48 therefrom.

Indicator means 26 has a light emitting diode (indicator lamp) 54 on club head 16 and cooperates with microbeam sensor 28 and switch means 32 as follows.

Figure 3:
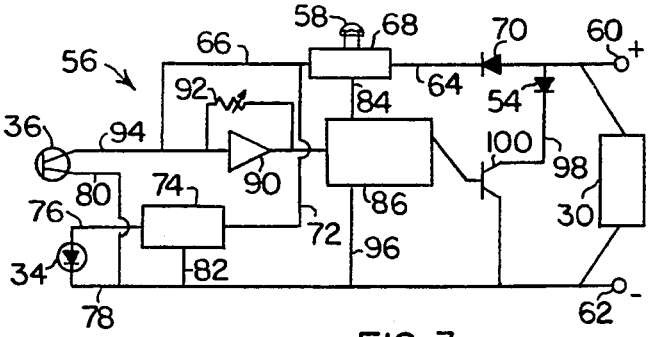
FIG. 3 is a block diagram of an electric sensing circuit in the golf apparatus.

Referring to FIG. 3, switch means 32 has an electrical sensing circuit, generally designated 56, which is selectively activated by a switch 58 for operating laser diode 34 and photo transistor 36. Sensing circuit 56 is interconnected between a positive terminal 60 and a negative terminal 62 on energy source 30 and conducts a signal for illuminating indicator lamp 54 when light emitted by laser diode 34 is received by photo transistor 36.

Specifically, positive terminal 60 is connected to photo transistor 36 by a wire 64 and a wire 66. Wire 64 extends between positive terminal 60 and a timer 68, and wire 66 extends between timer 68 and photo transistor 36. Timer 68 prevents current from flowing to photo transistor 36 when switch 58 remains activated for a predetermined length of time. Switch 58 preferably is a motion sensitive switch, such as a mercury switch, and prevents current from flowing to photo transistor 36 when golf club 12 is not in an upright orientation. A diode 70 on wire 64 provides reverse polarity protection and ensures that batteries 48 are properly installed in grip 18.

A wire 72 extends from wire 66 and thereby supplies electrical power to a high frequency modulator 74. High frequency modulator 74 preferably is a 12–14 kHz oscillator which supplies high current pulses to light emitting diode 34 on a wire 76. A return wire 78 connects light emitting diode 34 to negative terminal 62. A wire 80 connects photo transistor 36 to return wire 78 and a wire 82 connects high frequency modulator 74 to return wire 78.

A wire 84 extends from timer 68 and thereby supplies electrical power to a signal demodulator 86. An operating amplifier 90 and a gain control 92 condition an output signal carried on a wire 94 from photo transistor 36 to demodulator 86. A wire 96 connects demodulator 86 to return wire 78.

Indicator lamp 54 is connected between wire 64 and wire 78 by a wire 98 and a transistor 100. Transistor 100 acts as a switch operated by demodulator 86 for selectively permitting current to conduct along wire 98 and thereby illuminate indicator lamp 54.

Operation of switch means 32 is summarized as follows. Prior to activating switch 58, transistor 100 is off and current does not flow between positive terminal 60 and negative terminal 62. Consequently, none of high frequency modulator 74, signal demodulator 86, or indicator lamp 54 receives electrical power.

When switch 58 manually is actuated, a conductive flow path is opened and current flows from positive terminal 60 to negative terminal 62. Particularly, current conducts along wires 64 and 72 and activates high frequency modulator 74 whereby a series of high current pulses are transmitted to laser diode 34 along wire 76. Laser diode 34 emits a pulsed light signal at the frequency of the current pulses received from high frequency modulator 74. Current conducts from laser diode 34 to ground (i.e. negative terminal 62) along wire 78.

Current conducts also to photo transistor 36 along wire 66 when switch 58 is actuated. Photo transistor 36 transmits current pulses to demodulator 86 at a frequency equal to the frequency of light pulses received by the photo transistor. Normally, demodulator 86 conducts current to negative terminal 62 along wires 96 and 78. Since transistor 100 normally is closed, current does not conduct on wire 98 and indicator lamp 54 is not illuminated. However, when the frequency of current pulses received by demodulator 86 is equal to the frequency at which current pulses are transmitted by modulator 74 (thereby indicating that photo transistor 36 receives light transmitted by laser diode 34), demodulator 86 turns on transistor 100 and electricity conducts between positive terminal 60 and negative terminal 62, thereby illuminating indicator lamp 54.

Referring back to FIGS. 1 and 2, golf apparatus 10 is used to practice positioning club head 16 relative to golf ball 22 in an orientation wherein a line 104 which is perpendicular to club face 40 and which contains preferred contact point 49 intersects the center 106 of a golf ball 22 to be struck by club head 16. As discussed above, openings 38 and 44 are equidistantly spaced from opposite sides of preferred contact point 49. In addition, laser diode 34 is oriented relative to club head 16 such that an incident light beam 102 transmitted by the laser diode converges toward line 104 and intersects line 104 at a distance "d" from club face 40. Preferably, the incident light beam intersects line 104 at a location approximately two inches to four inches from club face 40.

The manner in which golf apparatus 10 is used now will be described. Club head 16 is held at a distance "d" from the center of a golf ball with which impact face 40 is to be aligned. Switch 56 then is manually actuated and incident light beam 102 is transmitted by laser diode 34. When club head 16 is positioned so that line 104 intersects golf ball center 106, light reflects from the surface of the ball at an angle equal to the angle of incidence of light beam 102. Since openings 38 and 44 are symmetric about line 104, a reflected light beam 108 is received in opening 44 and strikes photo transistor 36. The photo transistor, in turn, transmits a signal to demodulator 86 and turns on transistor 100. Current then conducts on wire 98 and illuminates indicator lamp 54.

Figure 4:
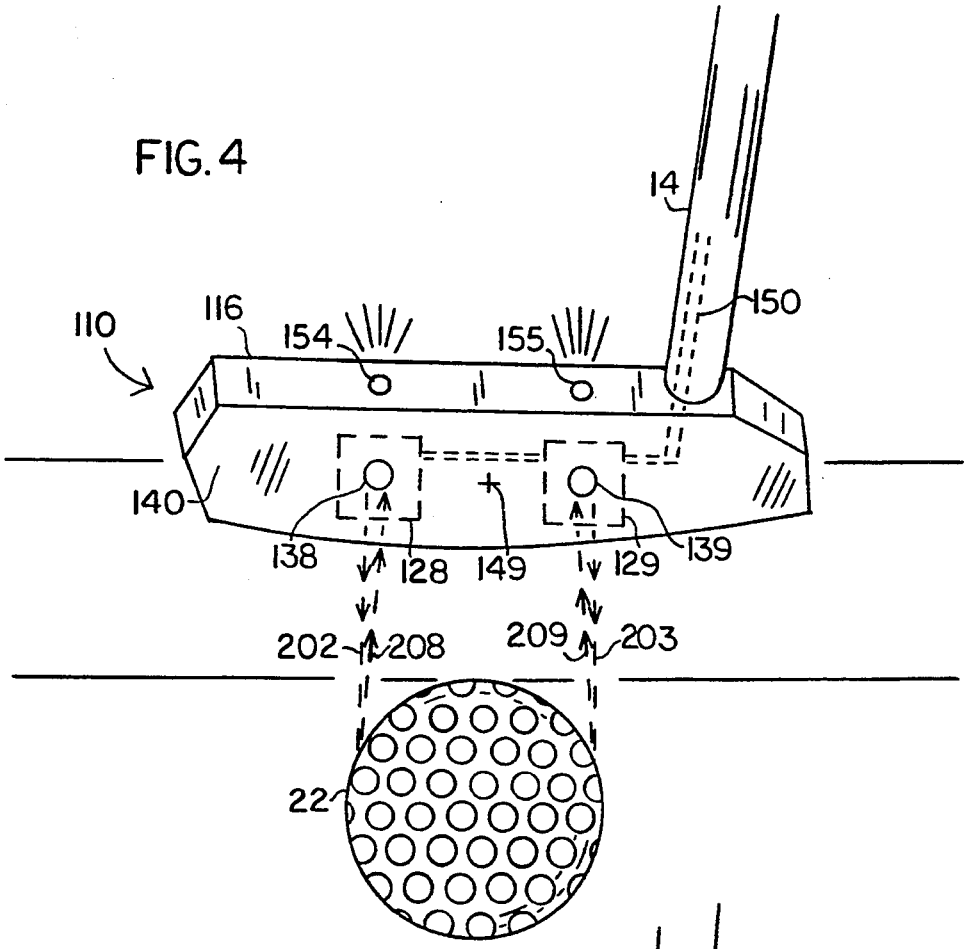
FIG. 4 is a schematic illustration of an alternative embodiment of the invention wherein a golf club head is in a preferred alignment with a golf ball.
Figure 5:
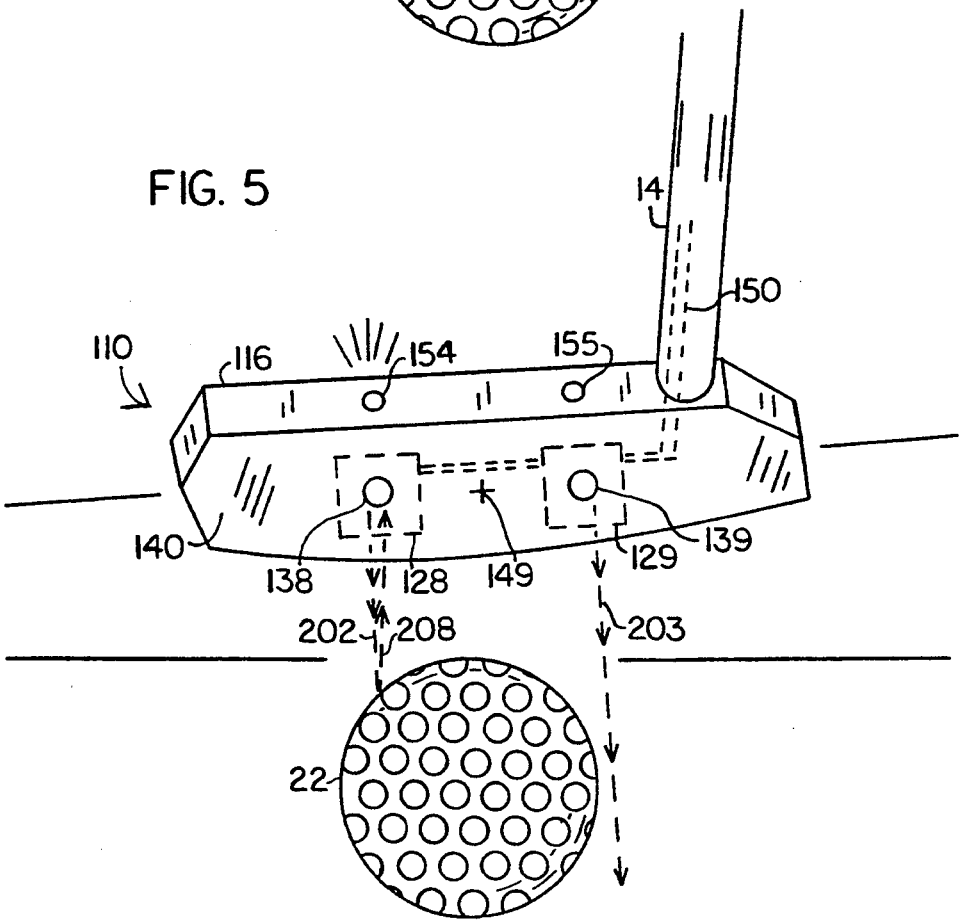
FIG. 5 is a schematic illustration of the alternative embodiment wherein the golf club head is misaligned with a golf ball.

An alternative embodiment of a golf apparatus is generally designated 110 in FIGS. 4 and 5 and has a golf club head 116 connected to the bottom end of club shaft 14. Club head 116 has a pair of embedded diffused reflective microbeam sensors 128 and 129 each having an associated light emitting laser diode and a light receiving photo transistor aligned with a corresponding opening 138 and 139, respectively, in the club face 140. Sensors 128 and 129 are commercially available devices, such as, by way of example only, devices marketed by Omron Electronics Inc. under the model number EE-SMR3-1. An electrical sensing circuit suitable for selectively conducting electrical power from energy source 30 to microbeam sensors 128 and 129 includes a wire 150 extending through club shaft 14.

More specifically, in a manner believed to be understood from the above description of sensing circuit 56, the electrical sensing circuit employed with the club head 116 is effective to illuminate an indicator lamp 154 when light transmitted by the light emitting diode in sensor 128 is reflected into the opening 138 and is received by the light receiving photo transistor in microbeam sensor 128. Similarly, an indicator lamp 155 is illuminated when light transmitted by the light emitting diode in sensor 129 is reflected into the opening 139 and is received by the light receiving photo transistor in microbeam sensor 129.

Openings 138 and 139 are equidistantly spaced from opposite sides of a point 149 of preferred contact on club face 140. Particularly, openings 138 and 139 are spaced from each other a distance slightly less than the diameter of a conventional golf ball 22. In a preferred embodiment, openings 138 and 139 are spaced from each other a distance in the range of approximately 1.4 inches to approximately 1.5 inches.

The manner in which golf apparatus 110 is used now will be described. Club head 116 is held in front of a golf ball with which impact face 140 is to be aligned. Operation of a suitable switch causes incident light beams 202 and 203 to be transmitted by the laser diode in the microbeam sensors 128 and 129, respectively. Microbeam sensors 128 and 129 are oriented relative to club head 116 such that when club head 116 is positioned so that a line perpendicular to club face 140 and which contains preferred contact point 149 intersects the center of golf ball 22, light reflects from the surface of the ball and is received by the photo transistors embedded in the club head. That is, when club head 116 is in a predefined alignment with a golf ball (FIG. 4), a reflected light beam 208 is received in opening 138 and strikes the photo transistor in microbeam sensor 128. The photo transistor then transmits a signal which illuminates indicator lamp 154. In a similar manner, when club head 116 is in a predefined alignment with a golf ball, a reflected light beam 209 is received in opening 139 and strikes the photo transistor in microbeam sensor 129. The photo transistor then transmits a signal which illuminates indicator lamp 155.

When club head 116 is not in the predefined alignment with a golf ball, such as when club face 140 is "closed" and club head 116 is in the "toe-in" position shown in FIG. 5, a line through contact point 149 and perpendicular to club face 140 does not intersect the center of golf ball 22, both incident beams 202 and 203 do not strike the golf ball, and as a result both indicator lamps 154 and 155 are not illuminated. For example, as shown in FIG. 5., when club head 116 is in the "toe-in" position, incident beam 203 does not strike or reflect from golf ball 22 and only indicator lamp 154 illuminates. As can be clearly inferred from the foregoing, when club head 116 is in a "toe-out" configuration wherein club face 140 is "open", incident beam 202 does not strike or reflect from golf ball 22 and only indicator lamp 155 illuminates.

The present invention thus provides an improved golf apparatus for practicing aligning the head of a golf club with a golf ball to be struck by the club head. The golf apparatus advantageously provides feedback to a golfer when the head of a golf club and a golf ball are in a predefined relative position without swinging the club. Specifically, and in the exemplary embodiments, a visible indication is provided that a line connecting the center of the golf ball and a point of preferred contact on the club face, such as the club head impact center, is perpendicular to the club face. In other words, an indication is provided that a club head is aligned in both a fore/aft direction (i.e., in a direction along the longitudinal axis of the club head) as well as in a desired rotational orientation (i.e., toe-in / toe-out) relative to a ball to be struck. Of course, as the golfer practices the proper position alignment of the club head, the golfer can proceed to swing the club, strike the ball and learn to maintain the proper position alignment of the club head as indicated by the apparatus of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A golf club apparatus for use in combination with a golf ball, comprising:

an elongated shaft with a club head at an end thereof, said club head having a substantially planar club face and a point of preferred contact for striking a golf ball when the club is swung;

sensing means comprising a source of light on the club head positioned to direct a beam of light at said golf ball and light receiving means on the club head for receiving light from said light source reflected by said golf ball, said sensing means being positioned such that light from said source is received by said light receiving means only when said club head is positioned relative to said golf ball such that a line formed by connecting the center of said golf ball and said point of preferred contact on said club head is perpendicular to said club face; and indicating means operatively associated with said sensing means for providing an indication that said light receiving means is receiving light from said light source reflected by said golf ball.

2. The golf apparatus of claim 4 in which said indicating means comprise an indicator light and means for activating said indicator light in response to reception of light from said light source by said light receiving means.

3. The golf apparatus of claim 2 in which said indicator light is located on the club head.

4. The golf apparatus of claim 1 in which said source of light is located in the club head and the club face has an outlet opening through which light is directed from said source at a golf ball to be struck by the club head.

5. The golf apparatus of claim 4 wherein the club face has a transparent window covering said outlet opening.

6. The golf apparatus of claim 1 in which said light receiving means is located in the club head and the club face has an inlet opening through which light is reflected from a golf ball.

7. The golf apparatus of claim 6 wherein the club face has a transparent window covering said inlet opening.

8. A golf club apparatus for use in combination with a golf ball, comprising:

an elongated shaft with a club head at an end thereof, said club head having a substantially planar club face and a point of preferred contact for striking a golf ball when the club is swung;

sensing means comprising a first source of light and a second source of light on the club head, each said source of light positioned to direct a beam of light at said golf ball, and first light receiving means on the club head for receiving light from said first light source reflected by said golf ball and second light receiving means on the club head for receiving light from said second light source reflected by said golf ball, said sensing means being positioned such that light from said first light source is received by said first light receiving means and light from said second light source is received by said second light receiving means only when said club head is positioned relative to said golf ball such that a line formed by connecting the center of said golf ball and said point of preferred contact on said club head is perpendicular to said club face; and indicating means operatively associated with said sensing means for providing an indication that said first light receiving means is receiving light from said first light source reflected by said golf ball and said second light receiving means is receiving light from said second light source reflected by said golf ball.

9. The golf apparatus of claim 8 in which said indicating means comprise a first indicator light and means for activating said first indicator light in response to reception of light from said first light source by said first light receiving means and a second indicator light and means for activating said second indicator light in response to reception of light from said second light source by said second light receiving means.

10. In a golf club having a club head with a substantially planar club face and a point of preferred contact for striking a golf ball when the club is swung, an apparatus for practicing aligning the club head with a golf ball prior to swinging the club, said apparatus comprising:

sensing means on the golf club comprising a source of light on the club head positioned to direct a beam of light at said golf ball and light receiving means on the club head for receiving light from said light source reflected by said golf ball, said sensing means being positioned such that light from said source is received by said light receiving means only when said club head is positioned relative to said golf ball such that a line formed by connecting the center of said golf ball and said point of preferred contact on said club head is perpendicular to said club face; and indicating means operatively associated with said sensing means for providing an indication that said light receiving means is receiving light from said reflected by said golf ball.

11. The golf apparatus of claim 10 in which said light source and said light receiving means are spaced equidistantly from said point of preferred contact on the club face.

12. The golf apparatus of claim 10 in which the sensing means comprise a microbeam sensor.

13. In a golf club having a club head with a substantially planar club face and a point of preferred contact for striking a golf ball when the club is swung, an...apparatus for practicing aligning the club head with a golf ball prior to swinging the club, said apparatus comprising:

sensing means on the golf club comprising a first source of light and a second source of light on the club head, each said source of light positioned to direct a beam of light at said golf ball, and first light receiving means on the club head for receiving light from said first light source reflected by said golf ball and second light receiving means on the club head for receiving light from said second light source reflected by golf ball, said sensing means being positioned such that light from said first light source is received by said first light receiving means and light from said second light source is received by said second light receiving means only when said club head is positioned relative to said golf ball such that a line formed by connecting the center of said golf ball and said point of preferred contact on said club head is perpendicular to said club face; and indicating means operatively associated with said sensing means for providing an indication that said first light receiving means is receiving light from said first light source reflected by said golf ball and said Second light receiving means is receiving light from said second light source reflected by said golf ball.

14. The golf apparatus of claim 13 in which said indicating means comprise a first indicator light and means for activating said first indicator light in response to reception of light from said first light source by said first light receiving means and a second indicator light and means for activating said second indicator light in response to reception of light from said second light source by said second light receiving means.

15. The golf apparatus of claim 13 in which said first light source and said second light source are spaced apart from each other a distance of approximately 1.4 inches.

16. The golf apparatus of claim 13 wherein the golf club has an energy source and includes switch means interconnected between the energy source and the sensing means for selectively interrupting a supply of energy from the energy source to the sensing means.

17. The golf apparatus of claim 16 wherein said switch means has motion sensitive means for automatically interrupting a supply of energy from the energy source when the golf club shaft is not substantially upright.

* * * * *

UNITED STATES PATENT AND TRADEMARK OFFICE

CERTIFICATE OF CORRECTION

PATENT NO. : 5,374,063

DATED : December 20, 1994

INVENTOR(S) : Everett L. Ogden

It is certified that error appears in the above-indentified patent and that said Letters Patent is hereby corrected as shown below:

Column 7, line 60, in the second claim, the reference numeral "4" should read —1—.

Signed and Sealed this

Twenty-third Day of May, 1995

*Attest:*

Bruce Lehman

BRUCE LEHMAN

*Attesting Officer*

*Commissioner of Patents and Trademarks*